US011735341B2

(12) United States Patent
Nakamura et al.

(10) Patent No.: US 11,735,341 B2
(45) Date of Patent: Aug. 22, 2023

(54) R-T-B-BASED SINTERED MAGNET

(71) Applicant: DAIDO STEEL CO., LTD., Nagoya (JP)

(72) Inventors: Michihide Nakamura, Nagoya (JP); Masaru Itakura, Fukuoka (JP)

(73) Assignee: DAIDO STEEL CO., LTD., Nagoya (JP)

( * ) Notice: Subject to any disclaimer, the term of this patent is extended or adjusted under 35 U.S.C. 154(b) by 0 days.

(21) Appl. No.: 16/551,325

(22) Filed: Aug. 26, 2019

(65) Prior Publication Data

US 2020/0075202 A1 Mar. 5, 2020

(30) Foreign Application Priority Data

Aug. 29, 2018 (JP) ..... 2018-160472

(51) Int. Cl.

| | |
|---|---|
| ***H01F 1/057*** | (2006.01) |
| ***C22C 38/16*** | (2006.01) |
| ***C22C 38/10*** | (2006.01) |
| ***C22C 38/00*** | (2006.01) |
| ***C22C 38/06*** | (2006.01) |

(52) U.S. Cl.

CPC ..... *H01F 1/0577* (2013.01); *C22C 38/002* (2013.01); *C22C 38/005* (2013.01); *C22C 38/06* (2013.01); *C22C 38/10* (2013.01); *C22C 38/16* (2013.01); *C22C 2202/02* (2013.01)

(58) Field of Classification Search

None

See application file for complete search history.

(56) References Cited

U.S. PATENT DOCUMENTS

| | | | |
|---|---|---|---|
| 2002/0007875 | A1 | 1/2002 | Yamamoto et al. |
| 2004/0118484 | A1 | 6/2004 | Nishizawa et al. |
| 2004/0166013 | A1 | 8/2004 | Nishizawa et al. |
| 2004/0177899 | A1 | 9/2004 | Nishizawa et al. |
| 2004/0187962 | A1 | 9/2004 | Ishizaka et al. |
| 2004/0187969 | A1 | 9/2004 | Ishizaka et al. |

(Continued)

FOREIGN PATENT DOCUMENTS

| | | | |
|---|---|---|---|
| CN | 1557004 | A | 12/2004 |
| CN | 101178962 | A | 5/2008 |

(Continued)

OTHER PUBLICATIONS

Machine translation of JP2002-075717A. (Year: 2002).*

(Continued)

*Primary Examiner* — Xiaowei Su

(74) *Attorney, Agent, or Firm* — McGinn I.P. Law Group, PLLC.

(57) ABSTRACT

The present invention relates to an R-T-B-based sintered magnet including: a rare earth element R; a metal element T which is Fe, or includes Fe and Co with which a part of Fe is substituted; boron; and a boride forming element M which is a metal element other than rare earth elements and the metal element T and forms a boride, in which the R-T-B-based sintered magnet includes: a main phase which includes a crystal grain of an R-T-B-based alloy; and a boride phase which includes a compound phase based on the boride of the boride forming element M, and is generated on a preferential growth plane of the crystal grain of the main phase.

19 Claims, 6 Drawing Sheets

(56) References Cited

U.S. PATENT DOCUMENTS

| | | | | |
|---|---|---|---|---|
| 2004/0187970 | A1 | 9/2004 | Ishizaka et al. | |
| 2011/0025440 | A1* | 2/2011 | Kuniyoshi | C22C 33/0278 335/302 |
| 2012/0107433 | A1 | 5/2012 | Sagawa et al. | |
| 2013/0026870 | A1 | 1/2013 | Baba et al. | |
| 2015/0221423 | A1 | 8/2015 | Mizoguchi et al. | |
| 2016/0293304 | A1 | 10/2016 | Hirota et al. | |
| 2016/0293305 | A1 | 10/2016 | Komura et al. | |
| 2017/0018342 | A1* | 1/2017 | Fukagawa | C22C 38/002 |
| 2017/0256344 | A1* | 9/2017 | Satoh | B22F 3/24 |
| 2018/0158583 | A1* | 6/2018 | Masusawa | C22C 33/025 |
| 2018/0221951 | A1 | 8/2018 | Fujikawa et al. | |
| 2019/0295752 | A1 | 9/2019 | Kitaoka et al. | |

FOREIGN PATENT DOCUMENTS

| | | | | | |
|---|---|---|---|---|---|
| CN | 102422367 | A | | 4/2012 | |
| CN | 103098151 | A | | 5/2013 | |
| CN | 104584148 | A | | 4/2015 | |
| CN | 105103249 | A | | 11/2015 | |
| EP | 1 164 599 | A2 | | 12/2001 | |
| JP | 2002-075717 | A | | 3/2002 | |
| JP | 2002075717 | A | * | 3/2002 | H01F 1/0577 |
| JP | 2017-147425 | A | | 8/2017 | |
| JP | 2019-169567 | A | | 10/2019 | |
| WO | WO 2017-022684 | A1 | | 2/2017 | |

OTHER PUBLICATIONS

Chinese Office Action, dated Sep. 2, 2020, in Chinese Application No. 201910801885.8 and English Translation thereof.

Extended European Search Report dated Feb. 13, 2020 for European Patent Application No. 19193813.3-1212.

Besenicar S et al: "The influence of Zr0"2 addition on the microstructure and the magnetic properties of Nd—Dy—Fe—B magnets", Journal of Magnetism and Magnetic Materials, Elsevier, Amsterdam, NL, vol. 104-107,Feb. 2, 1992(Feb. 2, 1992),pp. 1175-1178.

Bollero A et al: "NdDyFeBZre high-coercivity powders prepared by intense milling and the HDDR process", Journal of Alloys and Compounds, Elsevier Sequoia, Lausanne, CH, vol. 315, Jan. 1, 2001 (Jan. 1, 2001), pp. 243-250.

European Office Action, dated Dec. 23, 2021, in European Application No. 19 193 813.3.

Li H et al: "Crystal structure and elastic properties of ZrB compared with ZrB"2: A first-principles study", Computational Materials Science, Elsevier. Amsterdam, NL. vol. 49. No. 4, Oct. 2010 (Oct. 1, 2010) pp. 814-819.

Japanese Office Action dated May 31, 2022, in corresponding Japanese Patent Application No. 2018-160472, with an English translation thereof.

European Summons to attend Oral Proceedings dated Mar. 17, 2023, for European Patent Application No. 19 193 813.3-1212.

* cited by examiner

R-T-B-BASED SINTERED MAGNET

FIELD OF THE INVENTION

The present invention relates to an R-T-B-based sintered magnet, and more specifically relates to an R-T-B-based sintered magnet to which an element for forming a boride is added.

BACKGROUND OF THE INVENTION

An R-T-B-based sintered magnet (R is a rare earth element, T is Fe or includes Fe and Co with which a part of Fe is substituted) is used as one type of a rare earth magnet having high magnetic properties. In general, the R-T-B-based sintered magnet has crystal grains having a composition of $R_2T_{14}B$ as a main phase.

In the R-T-B-based sintered magnet, abnormal grain growth (AGG) in which crystal grains grow non-uniformly may occur during sintering. Abnormal grain growth causes a decrease in coercivity and squareness of the sintered magnet, and thus it is desired to suppress abnormal grain growth. For example, a form including a boride phase of a metal element selected from Ti, Zr and the like at a grain boundary triple point in the R—Fe—B based sintered magnet having a predetermined component composition and structure is disclosed in Patent Document 1. In Patent Document 1, the boride phase formed at the grain boundary triple point is regarded to play a role of suppressing abnormal grain growth during sintering.

Patent Document 1: JP-A-2017-147425

SUMMARY OF THE INVENTION

In the R-T-B-based sintered magnet, impurity elements O, C and N are liable to form a stable rare earth-impurity compound, that is, an oxide, carbide, or nitride containing a rare earth in a grain boundary phase. These rare earth-impurity compounds also have an effect of suppressing abnormal grain growth of a main phase due to a pinning effect.

However, when the rare earth-impurity compound as described above is formed in the grain boundary phase, a volume fraction of a rare earth element wetting and spreading to the grain boundary decreases, the coercivity of the entire sintered magnet decreases. Therefore, in the R-T-B-based sintered magnet, in order to obtain sufficient coercivity, it is intended to reduce a content of impurities. For example, in recent years, for molding and sintering a magnet material, a press-less process method (PLP method) is used in some cases. In the PLP method, a magnetic field is applied to an entire mold and raw material grains are oriented in a state in which a powder magnet material is filled into the mold. Then, sintering is performed for the powder magnet material with the mold in an atmosphere-controlled sintering chamber to obtain a sintered magnet. As in the background art, when a pressing step is performed, it is difficult to completely block contact of the magnet material to the atmosphere during the pressing, and impurities derived from the atmosphere such as O, C and N are easily contained in the magnet material. On the other hand, in the PLP method, a sintered body can be obtained without performing the pressing step while controlling an atmosphere. As a result, the content of impurities in the sintered body can be reduced.

When the content of impurities such as O, C and N in the R-T-B-based sintered magnet is reduced by adopting the PLP method or the like, it is difficult to use the effect of suppressing abnormal grain growth due to a rare earth-impurity compound. That is, it is necessary to sufficiently suppress abnormal grain growth by other means. As described in Patent Document 1, there is a possibility to suppress abnormal grain growth by forming the boride phase of the metal element such as Ti and Zr, even though a generation amount of the rare earth-impurity compound is small. However, a degree of contribution to inhibit abnormal grain growth may be different depending on a form of the formed boride. That is, as described in Patent Document 1, other than a form in which the boride phase is formed at the grain boundary triple point, a form in which abnormal grain growth can be suppressed effectively (or more effectively than the form described above) may be present.

An object of the present invention is to provide an R-T-B-based sintered magnet that can effectively suppress abnormal grain growth by forming a metal boride at a place other than a grain boundary triple point.

In order to achieve the above-described object, the present invention relates to the following configurations (1) to (7).

(1) An R-T-B-based sintered magnet including:

a rare earth element R;

a metal element T which is Fe, or includes Fe and Co with which a part of Fe is substituted;

boron; and a boride forming element M which is a metal element other than rare earth elements and the metal element T and forms a boride, in which the R-T-B-based sintered magnet includes:

a main phase which includes a crystal grain of an R-T-B-based alloy; and a boride phase which includes a compound phase based on the boride of the boride forming element M, and is generated on a preferential growth plane of the crystal grain of the main phase.

(2) The R-T-B-based sintered magnet according to (1), in which the boride phase is epitaxially grown on the preferential growth plane of the crystal grain of the main phase.

(3) The R-T-B-based sintered magnet according to (1) or (2), in which the main phase includes a tetragonal crystal having a preferential growth orientation being an a-axis direction and a b-axis direction, and the preferential growth plane includes at least one of a plane (110), a plane (100), and a plane (010).

(4) The R-T-B-based sintered magnet according to any one of (1) to (3), in which the boride forming element M includes at least one element selected from the group consisting of Ti, Zr, Hf, Nb and Cr.

(5) The R-T-B-based sintered magnet according to any one of (1) to (4), in which the main phase includes a tetragonal $Nd_2Fe_{14}B$ phase, and the boride phase includes a compound phase based on a hexagonal $ZrB_2$ structure, and the boride phase is epitaxially grown on the preferential growth plane of the crystal grain of the main phase in an orientation relationship of $Nd_2Fe_{14}B(110)[001]//ZrB_2(001)[100]$.

(6) The R-T-B-based sintered magnet according to any one of (1) to (5), including, in terms of mass %:

the rare earth element R in a total content of 27% to 33%;

Co in a content of 0% to 5%;

Al in a content of 0% to 1.0%;

Cu in a content of 0% to 0.5%;

the boride forming element M in a total content of 0.01% to 0.5%; and

B in a content of 0.9% to 1.2%, with a balance being Fe and inevitable impurities.

(7) The R-T-B-based sintered magnet according to any one of (1) to (6), in which each of contents of O, C and N is less than 1000 ppm by mass.

In the R-T-B-based sintered magnet according to the present invention, a boride phase is formed on a preferential growth plane of crystal grains of a main phase. The boride phase is present on the preferential growth plane, so that abnormal grain growth can be suppressed effectively by the boride phase.

Here, when the boride phase is epitaxially grown on the preferential growth plane of the crystal grains of the main phase, a crystal plane of the boride phase is aligned with the preferential growth plane of the crystal grains of the main phase, whereby the crystal of the boride phase can suppress abnormal grain growth of the main phase particularly effectively.

When the main phase includes a tetragonal crystal having a preferential growth orientation being an a-axis direction and a b-axis direction, the preferential growth plane includes at least one of a plane (110), a plane (100), and a plane (010), and thus abnormal grain growth can be effectively suppressed by generating the boride phase on the plane (110), the plane (100), and/or the plane (010) in main phases of various R-T-B-based sintered magnets having a tetragonal crystal structure in which the preferential growth orientation thereof is the a-axis direction and b-axis direction, such as $Nd_2Fe_{14}B$.

When a boride forming element M includes at least one element selected from the group consisting of Ti, Zr, Hf, Nb and Cr, these elements are liable to form the boride phase in the R-T-B-based sintered magnet, and the formed boride phase is excellent in the effect of suppressing abnormal grain growth of the main phase.

When the main phase includes a tetragonal $Nd_2Fe_{14}B$ phase and the boride phase includes a compound phase based on a hexagonal $ZrB_2$ structure, and the boride phase is epitaxially grown on the preferential growth plane of the crystal grains of the main phase in an orientation relationship of $Nd_2Fe_{14}B(110)[001]//ZrB_2(001)[100]$, the growth of the plane (110), which is the preferential growth plane, is liable to be inhibited by generation of the boride phase to the plane (110) of the $Nd_2Fe_{14}B$ phase, since the plane (110) of the $Nd_2Fe_{14}B$ phase well matches the plane (001) of the $ZrB_2$ phase. As a result, abnormal grain growth can be effectively suppressed.

When the R-T-B-based sintered magnet includes, in terms of mass %: the rare earth element R in a total content of 27% to 33%; Co in a content of 0% to 5%; Al in a content of 0% to 1.0%; Cu in a content of 0% to 0.5%; the boride forming element M in a total content of 0.01% to 0.5%; B in a content of 0.9% to 1.2%, with a balance being Fe and inevitable impurities, both high coercivity and high squareness can be easily achieved in the R-T-B-based sintered magnet by an effect due to the component composition and an effect of suppressing abnormal grain growth due to formation of the boride phase.

When each of contents of O, C and N is less than 1000 ppm by mass, the contents of these impurity elements are kept small, so that decrease in coercivity due to formation of the rare earth-impurity compound can be suppressed. In the R-T-B-based sintered magnet, the reduction in the content of the rare earth-impurity compound makes it difficult to use the effect of suppressing abnormal grain growth by such a compound, but it is possible to suppress abnormal grain growth and ensure the high coercivity since abnormal grain growth can be suppressed effectively by formation of the boride phase to the preferential growth plane of the crystal grains of the main phase.

BRIEF DESCRIPTION OF THE DRAWINGS

FIGS. 5A to 5D are graphs showing evaluation results of magnetic properties of the samples according to Comparative Example (no Zr contained) and Example (containing Zr), in which FIG. 5A shows coercivity of Comparative Example, FIG. 5B shows coercivity of Example, FIG. 5C shows squareness of Comparative Example, and FIG. 5D shows squareness of Example.

FIGS. 6A and 6B are graphs showing changes in magnetic properties due to a content of Zr, in which FIG. 6A shows coercivity, and FIG. 6B shows squareness.

DETAILED DESCRIPTION OF THE INVENTION

Figure 1A:
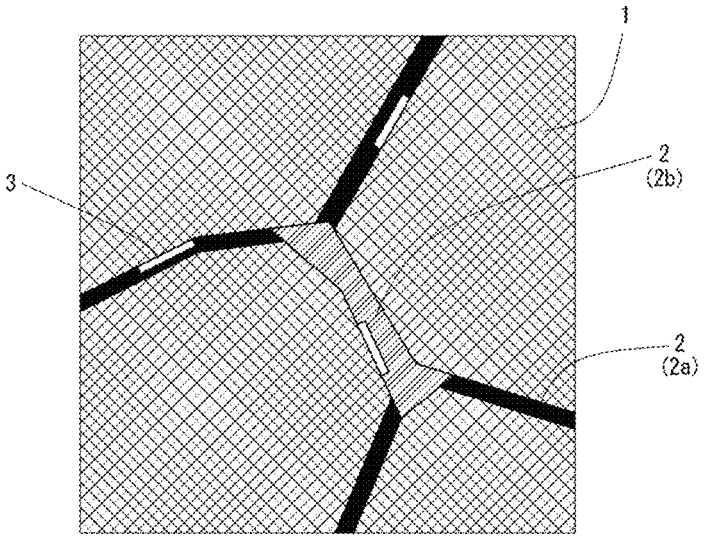
FIG. 1A is a schematic view showing a structure of an R-T-B-based sintered magnet according to an embodiment of the present invention.

An R-T-B-based sintered magnet according to an embodiment of the present invention (hereinbelow, sometimes simply referred to as a sintered magnet) will be described in detail below. In the present specification, contents of component elements are expressed using mass % and mass ppm as units. In addition, in the present specification, notation of the Miller indexes indicating a plane and an orientation in a crystal lattice includes a plane and an orientation equivalent to those described.

[Outline of R-T-B-based Sintered Magnet]

The R-T-B-based sintered magnet according to an embodiment of the present invention is formed by sintering a magnet material including a rare earth element R, a metal element T, boron (B), and a boride forming element M.

As long as the magnet material constituting the R-T-B-based sintered magnet includes the rare earth element R, the metal element T, B, and the boride forming element M, the specific composition thereof is not particularly limited. Examples of the rare earth element R include Nd, Pr, Dy, Tb, La and Ce. Among them, Nd can be suitably used as a rare earth element which is relatively inexpensive and has high magnetic properties. The rare earth element R may include only one kind or a plurality of kinds thereof. The metal element T is Fe, or includes Fe and Co with which a part of Fe is substituted.

The boride forming element M includes a metal element other than rare earth elements and the metal element T, and is an element that can form a boride by bonding with boron (B). Specific examples of the boride forming element M include Ti, Zr, Hf, Nb and Cr. Any of them can stably form a boride ($MB_2$) in a structure of the R-T-B-based sintered magnet. Among them, Ti, Zr, Nb and Hf can be suitably used since a stable boride is easily formed and an effect of suppressing abnormal grain growth, which will be described later, is excellent. Among them, Zr is the most suitable. The boride forming element M may include only one kind or a plurality of kinds thereof.

As described above, a specific composition of the R-T-B-based sintered magnet is not particularly limited as long as it includes the rare earth element R, the metal element T, B, and the boride forming element M, and the R-T-B-based sintered magnet may contain other elements. However, low contents of impurity elements O, C and N are desirable, and are preferably kept at a degree of inevitable impurities. Specifically, the content of each of O, C and N is preferably less than 1000 ppm. Further, the content of 0 is preferably less than 700 ppm, the content of C is preferably less than 500 ppm, and the content of N is preferably less than 400 ppm. These impurities form a stable rare earth-impurity compound (which is a compound formed by rare earth elements and impurities such as O, C and N) at a grain boundary triple point, and since the coercivity of the R-T-B-based sintered magnet is reduced by decreasing a volume fraction of the rare earth element R wetting and spreading to a grain boundary, the contents of these impurities are preferably kept small in view of ensuring high coercivity.

As an example of the composition of the R-T-B-based sintered magnet, the following may be mentioned:

the R-T-B-based sintered magnet including, in terms of mass %:

the rare earth element R in a total content of 27% to 33%;

Co in a content of 0% to 5%;

Al in a content of 0% to 1.0%;

Cu in a content of 0% to 0.5%;

the boride forming element M in a total content of 0.01% to 0.5%; and

B in a content of 0.9% to 1.2%, with a balance being Fe and inevitable impurities.

Here, a form in which each of Co, Al, and Cu is not contained is also included.

As a preferable example of the composition of the R-T-B-based sintered magnet, the following may be mentioned:

the R-T-B-based sintered magnet including, in terms of mass %:

the rare earth element R in a total content of 28% to 32%;

Co in a content of 0.8% to 2.5%;

Al in a content of 0.1% to 1.0%;

Cu in a content of 0.1% to 0.5%;

the boride forming element M in a total content of 0.05% to 0.2%; and

B in a content of 0.9% to 1.2%, with a balance being Fe and inevitable impurities.

The total content of the boride forming element M is preferably 0.01% or more, and more preferably 0.05% or more in view of sufficiently obtaining the effect of suppressing abnormal grain growth, which will be described later. However, when the boride forming element M is contained too much, an amount of B contained in a main phase decreases and the boride generated at the grain boundary inhibits aging of the sintered magnet by formation of the boride, whereby squareness of the sintered magnet in a demagnetization curve decreases. Here, the inhibition of aging by the boride means a phenomenon in which the boride generated at the grain boundary inhibits diffusion of an alloy having a high content of melted rare earth (rare earth rich phase) when an aging treatment is applied to the sintered magnet in order to optimize the coercivity. Due to such inhibition of aging, the coercivity of the entire sintered magnet cannot be effectively improved by the aging treatment, a spatial distribution of values of the coercivity occurs, and the squareness in the demagnetization curve decreases. Therefore, the total content of the boride forming element M is kept at preferably 0.5% or less, more preferably 0.2% or less, and even more preferably 0.1% or less.

In the R-T-B-based sintered magnet, the total content of the rare earth element R is preferably 27% or more, and more preferably 28% or more. Additionally, the total content of the rare earth element R is preferably 33% or less, and more preferably 32% or less.

Co, which is the metal element T, may or may not be contained in the R-T-B-based sintered magnet. When Co is contained, the content thereof is preferably 5% or less, and more preferably 2.5% or less. Additionally, the content of Co is preferably 0.8% or more.

Al may or may not be contained in the R-T-B-based sintered magnet. When Al is contained, the content thereof is preferably 1.0% or less. Additionally, the content of Al is preferably 0.1% or more.

Cu may or may not be contained in the R-T-B-based sintered magnet. When Cu is contained, the content thereof is preferably 0.5% or less. Additionally, the content of Cu is preferably 0.1% or more.

In the R-T-B-based sintered magnet, the content of boron (B) is preferably 1.2% or less. Additionally, the content of boron (B) is preferably 0.9% or more.

The R-T-B-based sintered magnet can be produced by molding raw material powder having the composition as described above into a desired shape, and sintering after orienting grains in a magnetic field. Although a specific production method thereof is not particularly limited, it is preferable to use a press-less process method (PLP method) that can complete molding and sintering without a pressing step. In the PLP method, raw material powder is filled into a mold formed by a carbon material or the like and having a desired shape. Next, a magnetic field is applied to the entire mold to orient the grains of the raw material powder. After the magnetic field is applied, the mold is heated at a predetermined sintering temperature in an atmosphere-controlled heating chamber and the raw material powder is sintered, whereby the sintered magnet is obtained. It is difficult to block contact between the raw material powder and the atmosphere during press working in a conventional production method in which the raw material powder is molded by performing press working in the magnetic field and then sintering is performed. On the other hand, in the PLP method, each step from production of the raw material powder to filling it into the mold and sintering can be performed by controlling an atmosphere, and thus the content of impurities derived from air, such as O, C and N, can be significantly reduced in the produced sintered magnet. After sintering, the aging treatment is preferably applied at a temperature lower than the sintering temperature.

[Structure of R-T-B-based Sintered Magnet]

Next, a structure of the R-T-B-based sintered magnet according to this embodiment will be described.

FIG. 1A shows a schematic view of a state of the structure of the R-T-B-based sintered magnet according to this embodiment. Most of the structure is occupied by main phase crystal grains 1. Typically, the main phase crystal grains 1 include a tetragonal $R_2T_{14}B$ phase (such as a $Nd_2Fe_{14}B$ phase).

A grain boundary phase is formed at a grain boundary 2 between the main phase crystal grains 1, that is, at a two-grain boundary 2*a* and a grain boundary triple point 2*b*. The grain boundary phase includes an alloy phase (GBP 1 in Example) formed by wetting and spreading the rare earth element R to the grain boundary 2. In the alloy phase, the rare earth element R is concentrated more than the main phase, and is typically based on a composition of $R_3T$. Further, the grain boundary phase includes an oxide phase (GBP2 of Example) in addition to the alloy phase. The oxide phase substantially include an oxide of the rare earth element R.

Further, a boride phase 3 is formed at the grain boundary 2 between the main phase crystal grains 1. The boride phase 3 includes a compound phase based on the boride ($MB_2$) in which the boride forming element M and boron (B) are bonded to each other. The boride phase 3 is generated in close contact so as to be stuck to a facet of the main phase crystal grains 1, that is, a part of a crystal plane exposed from an end face.

Here, "a compound phase based on a boride" of the boride phase 3 refers to a compound phase consisting of a boride and inevitable impurities or a compound phase including a boride as a main component and optionally including other compounds. The composition of the boride is typically $MB_2$, that is, a ratio of the boride forming elements M and B is 1:2, but the ratio may deviate therefrom. In addition, in the following, a case where the boride forming element M is Zr is described as "a compound phase based on a hexagonal $ZrB_2$ structure", and this means a compound phase having a $ZrB_2$ phase of a hexagonal $AlB_2$ type structure or having a structure derived from a $ZrB_2$ phase.

Figure 1B:
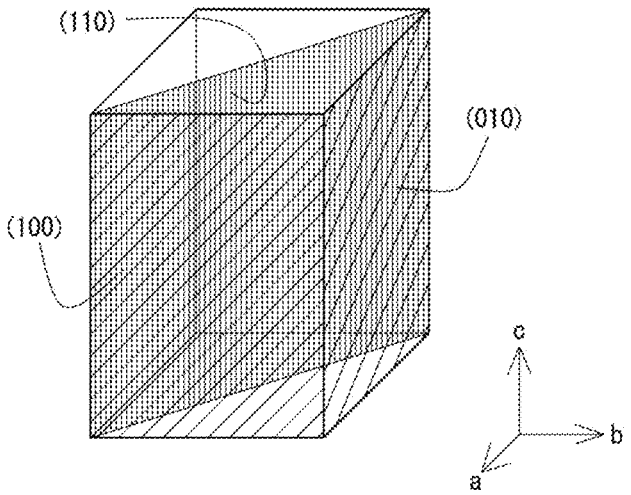
FIG. 1B is a schematic view of a crystal lattice explaining a relationship between axes a, b, and c and planes (110), (100), and (010) in a tetragonal crystal.

Among the facets of the main phase crystal grains 1, a facet on which the boride phase 3 is generated is a preferential growth plane, namely, a facet in a direction of intersecting with the preferential growth orientation of the main phase crystal grains 1 (axis of the preferential growth orientation intersects with a plane of the facet). When the main phase crystal grains 1 include a tetragonal $R_2T_{14}B$ phase such as a $Nd_2Fe_{14}B$ phase, the preferential growth orientation is the a-axis direction and the b-axis direction in many cases. In this case, the preferential growth plane includes a plane (100), a plane (010), and a plane (110) in which the a-axis and the b-axis are normal lines as shown in FIG. 1B.

Since the boride phase 3 is formed on the preferential growth plane of the main phase crystal grains 1, the boride phase 3 prevents crystal growth of the main phase crystal grains 1 along the preferential growth orientation. As a result, abnormal grain growth is difficult to occur in the main phase crystal grains 1 during sintering, and a state in which the main phase crystal grains 1 are composed of fine grains is easily maintained.

It has been confirmed by a structure observation using a scanning electron microscope (SEM) that the main phase crystal grains 1 having a grain size of more than 20 μm are generally formed when abnormal grain growth occurs. However, in the sintered magnet according to this embodiment, abnormal grain growth is suppressed by generation of the boride phase 3, so that a grain size of the main phase crystal grains 1 is suppressed to less than the grain size of abnormal crystal grains, such as 20 μm or less, and the state of the fine grains can be maintained. As will be described later, in view of increasing a ratio of the grain boundary in the structure and increasing an amount of the boride phase 3 generated at the grain boundary, an average grain size of the main phase crystal grains 1 is preferably 4 μm or less. Here, the grain size of the main phase crystal grains 1 can be determined as an equivalent circle diameter of crystal grains in a plane perpendicular to an orientation direction (c-axis direction) of the main phase crystal grains 1 by observing the structure with a SEM. An average grain size is obtained as a value of 50% of the cumulative grain size (diameter) thus determined (D50).

When there are a plurality of preferential growth planes, the boride phase 3 is preferably generated by close contact with at least one of the preferential growth planes. As described above, in a case where the main phase includes a tetragonal crystal having a preferential growth orientation being an a-axis direction and a b-axis direction, when the boride phase 3 is generated on at least the plane (110) among three preferential growth planes of the plane (110), the plane (100), and the plane (010), it is possible to suppress growth of the main phase crystal grains along the preferential growth orientation of both the a-axis direction and the b-axis direction. Therefore, such a configuration is preferable. Since the crystal of $R_2T_{14}B$ such as $Nd_2Fe_{14}B$ is difficult to grow in the c-axis direction and is liable to grow preferentially in the a-axis direction and the b-axis direction, preferential growth is effectively suppressed by generating the boride phase 3 on planes a and b.

A crystal structure and growth mode of the boride phase 3 generated on the preferential growth plane of the main phase crystal grains 1 are not particularly limited, but the boride phase 3 is preferably epitaxially grown on the preferential growth plane. The epitaxial growth of the boride phase 3 occurs in a plane having good matching of atomic arrangement between the main phase crystal grains 1 and the boride phase 3. When the boride phase 3 is epitaxially grown on the preferential growth plane of the main phase crystal grains 1, the boride phase 3 inhibits growth of the preferential growth plane having a relatively fast growth rate in the main phase crystal grains 1, whereby abnormal grain growth can be effectively suppressed.

Among the plurality of preferential growth planes of the main phase crystal grains 1, which of the preferential growth planes the boride phase 3 is epitaxially grown depends on the specific composition and crystal structure of the main phase (the main phase crystal grains 1) and the boride phase 3. For example, when the main phase (the main phase crystal grains 1) includes the tetragonal $Nd_2Fe_{14}B$ phase and the boride phase 3 includes a compound phase based on the hexagonal $ZrB_2$ structure, the epitaxial growth of the boride phase 3 is liable to occur in an orientation relationship of $Nd_2Fe_{14}B(110)[001]//ZrB_2(001)[100]$. That is, in a state where a [001] direction of the plane (110) of the $Nd_2Fe_{14}B$ phase and a [100] direction of the plane (001) of the $ZrB_2$ phase are aligned, the $ZrB_2$ phase is liable to be epitaxially grown on the preferential growth plane (110) of the $Nd_2Fe_{14}B$ phase. Since the plane (110) of the $Nd_2Fe_{14}B$ phase and the plane (001) of the $ZrB_2$ have good matching of the atomic arrangement in the crystal structure, the boride phase 3 based on $ZrB_2$ is epitaxially grown on the plane (110) of the $Nd_2Fe_{14}B$ phase with the above-described crystal orientation relationship, which inhibits growth of the plane (110) that is the preferential growth plane and suppresses abnormal grain growth in the main phase crystal grains 1.

In the sintered magnet according to this embodiment, as shown in FIG. 1A, the boride phase 3 can be formed on both of a preferential growth plane facing a two-grain boundary 2*a* in which two main phase crystal grains 1 are adjacent to each other and a preferential growth plane facing a grain boundary triple point 2*b* among the preferential growth planes of the main phase crystal grains 1. In contrast, there is also a case where the boride phase 3 is formed exclusively at the grain boundary triple point 2*b*, such as a form disclosed in Patent Document 1. However, as shown in this embodiment, the boride phase 3 is also formed on the preferential growth plane facing the two-grain boundary 2*a*, so that abnormal grain growth can be effectively suppressed in the main phase crystal grains 1. It is considered that this is because the two-grain boundary 2*a* obtains a larger anchor effect (pinning effect) by generating the boride phase 3 at the two-grain boundary 2*a*, as compared with the grain boundary triple point 2*b*, since a total area of a grain interface in contact with the main phase crystal grains 1 is larger in the two-grain boundary 2*a* than the grain boundary triple point 2*b*.

In the R-T-B-based sintered magnet, when abnormal grain growth occurs, the squareness in the demagnetization curve decreases. This is because the abnormal growth grains are easily magnetization-reversed. However, the squareness in the demagnetization curve can be improved by suppressing abnormal grain growth by generation of the boride phase 3.

In Patent Document 1, the boride phase is described to be formed at the grain boundary triple point, but in the R-T-B-based sintered magnet according to this embodiment, as described above, the boride phase 3 is generated at the two-grain boundary 2*a* in addition to the grain boundary triple point 2*b*, thereby effectively suppressing abnormal grain growth. It is assumed that the generation of the boride phase 3 into the two-grain boundary 2*a* is related to an amount of impurities such as O, C and N contained in the magnet material constituting the sintered magnet, and the boride phase 3 is easily generated at the two-grain boundary 2*a* by reducing the contents of these impurities.

As described above, although the impurities such as O, C and N have the effect of suppressing abnormal grain growth of the main phase by pinning due to the formation of the rare earth-impurity compound, it is difficult to use the effect of suppressing abnormal grain growth due to the formation of the rare earth-impurity compound by reducing the content of the impurities. However, the boride phase 3 is distributed at the two-grain boundary 2*a* by reducing the contents of these impurities, and a state in which the effect of suppressing abnormal grain growth by the rare earth-impurity compound cannot be utilized is compensated by using the effect of suppressing abnormal grain growth by the boride phase 3, whereby abnormal grain growth can be effectively suppressed overall.

The contents of the impurities can be reduced by using, for example, the PLP method, but in the PLP method, the abnormal grain growth is liable to occur by reducing the contents of the impurities as compared with a general molding and sintering method in the background art accompanying press working. However, since a boride forming element M is added and the boride phase 3 is formed on the preferential growth plane of the main phase crystal grains 1, abnormal grain growth due to these factors can be effectively suppressed. As a result, it is possible to ensure high coercivity by reducing the contents of impurities and to improve squareness by suppressing abnormal grain growth.

Further, even though a particle size of the raw material powder is small, by using the PLP method, it is easy to achieve molding into a predetermined shape and orientation as compared with the general molding/sintering method accompanying press working. As a result, a sintered magnet having a small grain size of the main phase crystal grains 1 is easily obtained. As the grain size of the main phase crystal grains 1 decreases, a ratio of grain boundaries (the two-grain boundary 2*a* and the grain boundary triple point 2*b*) in the entire structure of the sintered magnet increases. In addition, the ratio of the two-grain boundary 2*a* to the grain boundary triple point 2*b* is also easy to increase. As a result, an amount of the boride phase 3 formed at a grain boundary, particularly at the two-grain boundary 2*a* increases, whereby a high effect can be obtained in suppressing abnormal grain growth. The average grain size of the main phase crystal grains 1 is preferably 4 μm or less.

Further, the boride forming element M is added to the R-T-B-based sintered magnet, so that in addition to the effect of suppressing abnormal grain growth by formation of the boride phase 3 on the preferential growth plane of the main phase crystal grains 1, a ratio of an alloy phase (GBP1) to an oxide phase (GBP2) in the grain boundary phase can be improved. The coercivity of the sintered magnet can be improved by increasing a volume fraction of the alloy phase in the grain boundary phase. By adding the boride forming element M and generating the boride phase 3, boron (B) for forming $R_2T_{14}B$ and $R_1T_4B_4$ which are compounds constituting the main phase crystal grains 1 is consumed to form the boride phase 3, and the excess rare earth element R and metal element T form an alloy phase at the grain boundary 2, so that it is considered that the ratio of the alloy phase to the oxide phase increases.

Examples

Examples of the present invention are shown below. The present invention is not limited by these Examples.

[1] Structure of R-T-B-based Sintered Magnet

First, a state of the structure of the R-T-B-based sintered magnet was examined by a microscopic observation.

(Test Method)

Raw material powder having a composition of $Nd_{26.90}Pr_{4.7}Co_{0.9}B_{0.99}Al_{0.2}Cu_{0.1}Zr_xFe_{bal.}$ (mass %; x=0.1) was produced and then molded and sintered by a PLP method as a sample according to Example. A filling density was 3.4 g/mm$^3$, and after filling, a magnetic field was applied and grains were oriented in c-axis. Sintering was performed in vacuum at 975° C. for 8 hours. After the sintering, an aging treatment was performed in two stages: at 800° C. for 30 minutes; and at 520° C. for 90 minutes.

Further, a sample according to Comparative Example which did not contain Zr, that is, x=0 in the above-described composition of the raw material powder was prepared. Then, molding and sintering by the PLP method, and aging treatment were performed in the same manner as described above. In addition, it was confirmed that a content of 0 was less than 700 ppm, a content of C was less than 500 ppm, and a content of N was less than 400 ppm as contents of impurities in both of Comparative Example and Example.

Precision machine polishing and ion polishing were performed on the samples according to Example and Comparative Example obtained above. Then, surfaces of the samples were observed with a scanning electron microscope (HRSEM) having an energy dispersive X-ray spectroscope (EDS). In addition, small pieces were picked from the samples by a focused ion beam, the small pieces to which ion polishing was applied were observed by a transmission electron microscope (Cs-STEM) having an ESD system.

(Test Result)

Figure 2A:
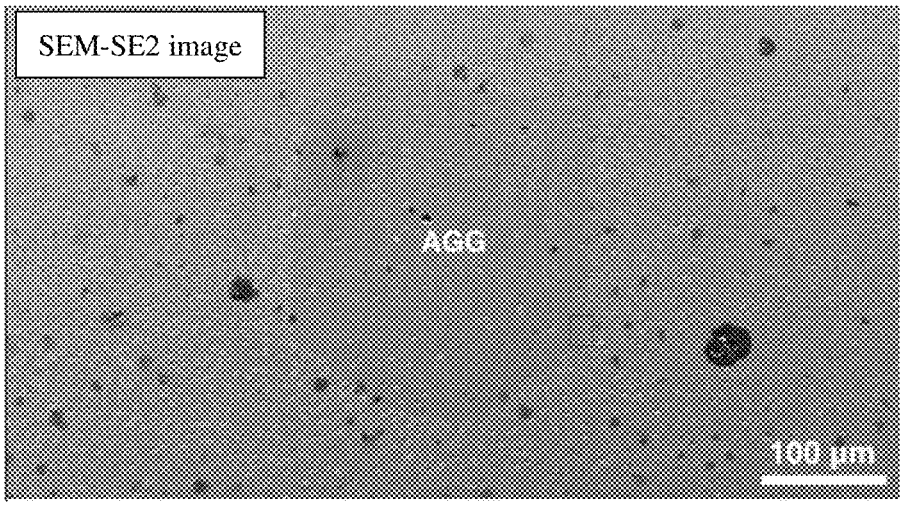
FIG. 2A is a SEM-SE2 image of a sample according to Comparative Example (no Zr contained)
Figure 2B:
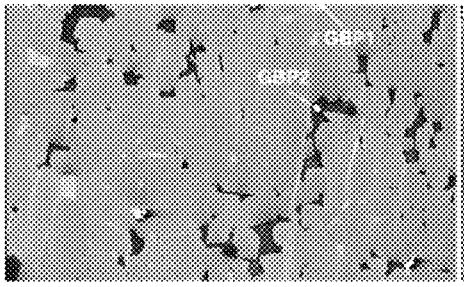
FIG. 2B is a SEM-inlens image of the sample according to Comparative Example (no Zr contained)
Figure 2C:
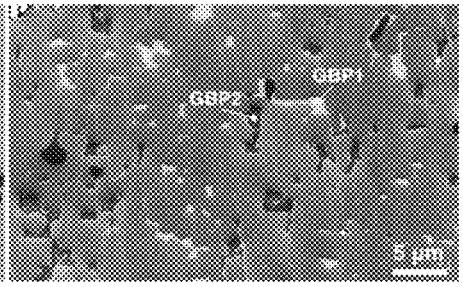
FIG. 2C is a SEM-inlens image of a sample according to Example (containing Zr).

FIGS. 2A to 2C show SEM observation images. FIG. 2A shows a wide-area SEM image (secondary electron image) obtained for the sample according to Comparative Example in which Zr was not added. An abnormal growth grain AGG having a grain size of several hundred microns is seen in the observation image. This SEM image is an image of secondary electrons on a relatively high energy side (so-called SE2 image), and an image sensitive to unevenness of the surface is obtained.

On the other hand, when a wide-area SEM observation was performed on the sample according to Example in which Zr was added, the similar coarse abnormal growth grain was not observed. From this, it was confirmed that abnormal grain growth can be suppressed by adding Zr.

Further, a high-magnification SEM image was obtained to observe a structure state of the samples according to Comparative Example and Example in detail. This SEM image is an image formed by capturing secondary electrons on the relatively low energy side preferentially (so-called inlens image), and a high-resolution image extremely sensitive to the surface state of the sample is obtained.

The images obtained in Comparative Example and Example are shown in FIGS. 2B and 2C, respectively. In Comparative Example of FIG. 2B, a region in which the abnormal growth grain (AGG) as observed in FIG. 2A was not formed was selected and observed.

When the observation image according to Comparative Example of FIG. 2B is viewed, a first grain boundary phase GBP1 observed in gray brighter than the main phase and a second grain boundary phase GBP2 observed in gray darker than the main phase are formed at a grain boundary between crystal grains observed in slightly bright gray.

A component composition of each phase was analyzed by SEM-ESD, and it was confirmed that the main phase includes an $R_2T_{14}B$ phase. GBP1 was an alloy phase having a composition of substantially $R_3T$. On the other hand, GBP2 was an oxide phase including substantially a rare earth oxide.

In the observation image (FIG. 2C) of the sample according to Example in which Zr was added, two grain boundary phases of the alloy phase GBP1 and the oxide phase GBP2 were formed at the grain boundary between crystal grains of the main phase in the same manner as a ease of Comparative Example, However, a ratio of the alloy phase GBP1 to the oxide phase GBP2 in a case of Example was higher than that in Comparative Example. In addition, in Example, the finer alloy phase GBP1 was formed, and the alloy phase GBP1 occupied a space between crystal grains more densely, as compared with Comparative Example. As a result, it is seen that the volume fraction of the alloy phase GBP1 in the grain boundary phase increases and the alloy phase is densely wet and spreads to the main phase grain boundary by adding Zr.

Figure 3:
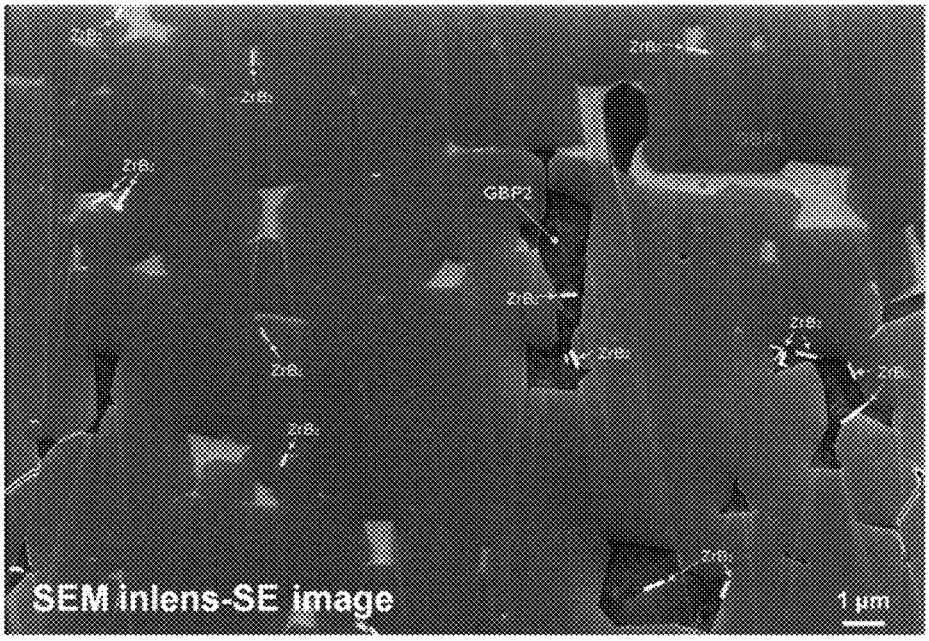
FIG. 3 is an SEM-inlens image at a high magnification of the sample according to Example.

Further, FIG. 3 shows a high-magnification SEM-inlens image of the sample according to Example. According to this, it is seen that in addition to two grain boundary phases GBP1 and GBP2, a plate-shaped substance having a length of about 0.5 μm which is observed remarkably bright was generated at the grain boundary of the main phase crystal grains. A component composition of the substance was analyzed by SEM-ESD, and it was found that the substance was $ZrB_2$. That is, Zr added to the raw material powder was distributed at the grain boundary of the main phase crystal grains as a boride.

In FIG. 3, the plate-shaped boride phases are generated in close contact so as to be stuck to the facet of the main phase crystal grains. Also, there are the boride phases generated so as to be embedded in the grain boundary phases GBP1 and GBP2 in the image, and it is considered that they are generated on the facet of the main phase crystal grains present above and below the grain boundary phase.

Figure 4:
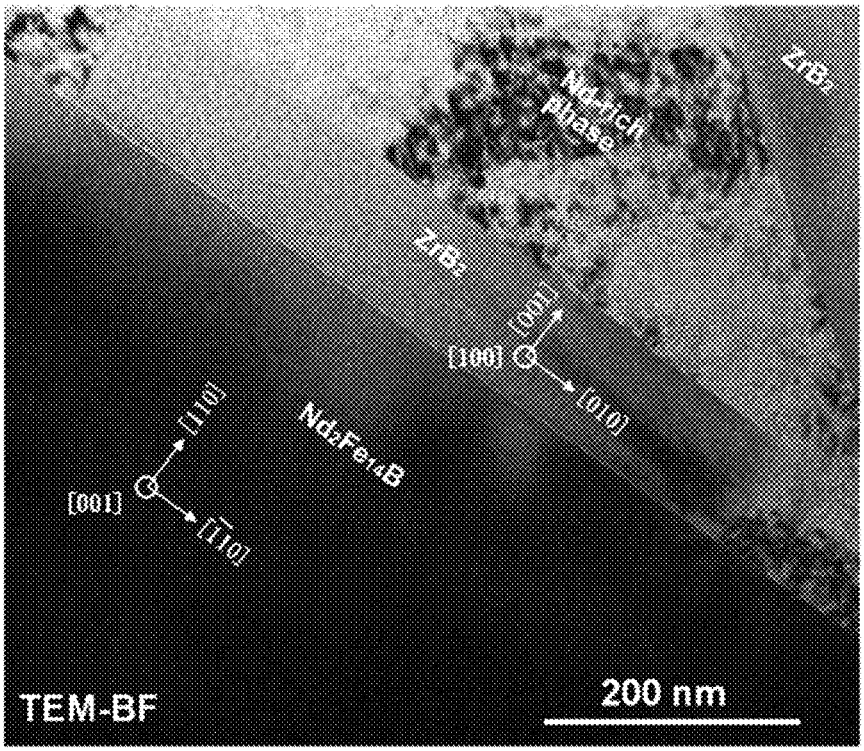
FIG. 4 shows a TEM-BF image of a region near the boride phase of the sample according to Example.

Further, an interface between the main phase crystal grains and the boride phase was observed by TEM to examine a relationship therebetween. First, FIG. 4 shows a TEM bright field (BF) image of a cross section. According to this, it is seen that the plate-shaped boride phase having a length of about 500 nm and a thickness of about 100 nm (a compound phase based on $ZrB_2$) is generated in close contact so as to be stuck to the plane (110) of the main phase crystal grains ($Nd_2Fe_{14}B$ phase).

The orientation relationship between the main phase crystal grains and the $ZrB_2$ phase generated on the facet in the BF image of FIG. 4 was confirmed by selected area electron diffraction (SAD). In SAD, in addition to diffraction spots of [001] incidence of the $Nd_2Fe_{14}B$ phase, diffraction spots corresponding to [100] incidence of the $ZrB_2$ phase ($AlB_2$ type, a=0.32 nm, b=0.32 nm, c=0.35 nm) were also observed. Then, the [110] direction of the $Nd_2Fe_{14}B$ phase coincided with the [001] direction of the $ZrB_2$ phase. The orientation relationship between the main phase crystal grains and the $ZrB_2$ phase, which has become apparent from these results, is indicated by each of arrows in the BF image in FIG. 4. According to this, it is seen that the plane (001) of the $ZrB_2$ phase is epitaxially grown in parallel with and on the plane (110) of the main phase crystal grains, and an orientation relationship therebetween is $Nd_2Fe_{14}B(110)[001]//ZrB_2(001)[100]$.

[2] Magnetic properties of R-T-B-based sintered magnet

Magnetic properties of the R-T-B-based sintered magnet were then evaluated in cases of adding and not adding Zr. Specifically, coercivity and squareness were evaluated.

(Test Method)

As the samples according to Example and Comparative Example, the sintered magnets each having the component composition shown in Table 1 below were produced in the same method as the test of the "structure of R-T-B-based sintered magnet" shown above. However, the sintering temperature and sintering time were changed as shown in a legend and a horizontal axis in FIGS. 5A to 5D.

TABLE 1

| | Contained metal [mass %] | | | | | | | | | | Impurities [ppm] | | | |
|---|---|---|---|---|---|---|---|---|---|---|---|---|---|---|
| | TRE | Nd | Pr | Tb | Co | B | Al | Cu | Zr | Fe | O | C | N | H |
| Comparative Example | 32.0 | 26.7 | 4.75 | 0.56 | 0.91 | 0.97 | 0.22 | 0.12 | 0.00 | Bal. | 630 | 469 | 200 | 2 |
| Example | 32.2 | 26.8 | 4.77 | 0.58 | 0.91 | 0.97 | 0.22 | 0.12 | 0.03 | Bal. | 623 | 425 | 199 | 2 |

"TRE" represents a total content of rare earth elements.

A magnetization curve was measured on the samples according to Example and Comparative Example subjected to sintering under each condition. The measurement was performed using a pulse excitation magnetic property measuring device. Then, values of coercivity $_iH_c$ were recorded. Squareness was evaluated from a shape of the demagnetization curve. Here, in the demagnetization curve, when a value of a magnetic flux density B is 90% of a residual magnetic flux density $B_r$, a value of the magnetic field H is $H_{k90}$, coercivity is $_iH_c$, and squareness is evaluated as $H_{k90}/_iH_c$.

(Test Result)

Figure 5A:
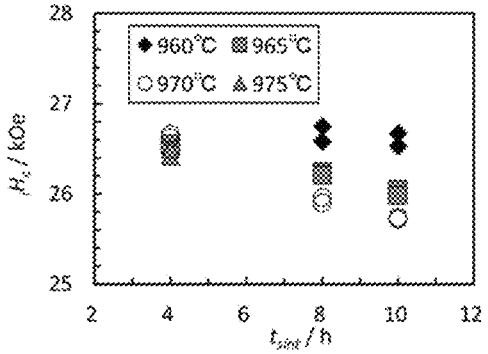
Figure 5B:
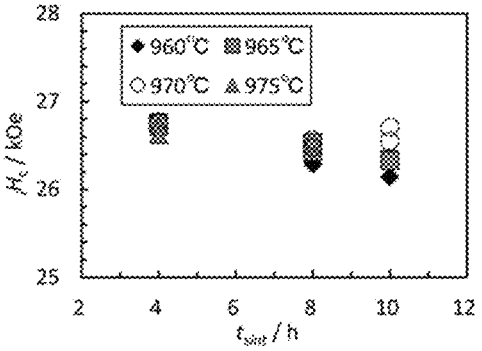
Figure 5C:
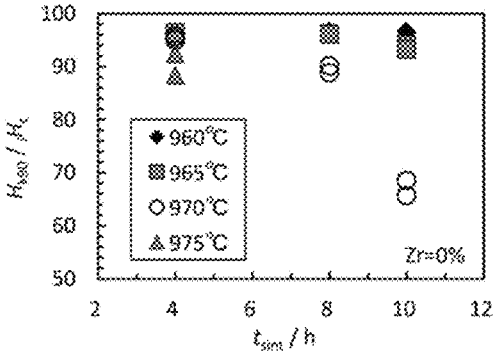
Figure 5D:
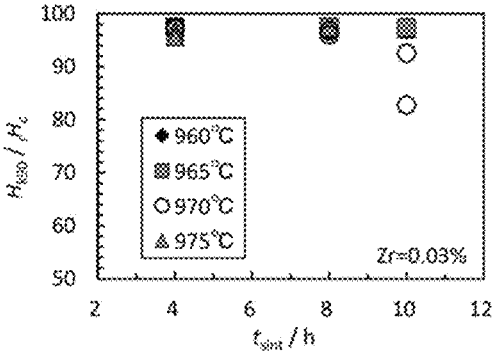

FIGS. 5A to 5D show evaluation results of the magnetic properties. FIG. 5A and FIG. 5B are measurement results of the coercivity ${}_iH_c$, in which FIG. 5A shows Comparative Example, and FIG. 5B shows Example. FIG. 5C and FIG. 5D are evaluation results of the squareness $H_{k90}/{}_iH_c$, in which FIG. 5C shows Comparative Example, and FIG. 5D shows Example. In any cases, sintering temperature is varied to four temperatures in a range of 960° C. to 975° C., and sintering time is varied in a range of 4 to 11 hours as shown in the horizontal axis. The sintering time of 4 hours and 11 hours used here assumes a length of time in which each of an individual which is relatively difficult to be heated and an individual which is relatively easy to be heated is heated at a predetermined temperature when a large quantity of individuals are stacked in a mountain shape to perform sintering in a mass production step of the R-T-B-based sintered magnet.

First, according to the measurement result of the coercivity of Comparative Example in FIG. 5A, the coercivity decreases as the sintering temperature increases and the sintering time increases. On the other hand, according to the measurement result of the coercivity of Example in FIG. 5B, sintering temperature dependency and sintering time dependency of the coercivity decrease as compared with the case of Comparative Example. In many sintering conditions, a value of the coercivity is larger than that of Comparative Example. In particular, when sintering is performed at a high temperature for a long time, a difference in coercivity between Example and Comparative Example increases.

Next, according to the evaluation result of the squareness in Comparative Example of FIG. 5C, the squareness decreases as the sintering temperature increases and the sintering time increases, as the case of coercivity. On the other hand, according to the evaluation result of the squareness of Example in FIG. 5D, sintering temperature dependency and sintering time dependency of the squareness decrease as compared with the case of Comparative Example. In addition, an evaluation value of the squareness is larger than that of Comparative Example in all sintering conditions. Particularly, in an area where the sintering time is 8 hours or less, the squareness does not substantially depend on the sintering temperature and the sintering time, and large values of 95% or more are obtained.

As described above, both the coercivity and squareness are less dependent on the sintering temperature and the sintering time, and values thereof are larger in Example containing Zr than Comparative Example not containing Zr. When Zr is not contained, it can be interpreted that abnormal grain growth of the main phase occurs, so that the coercivity and squareness of the sintered magnet decrease. Abnormal grain growth and accompanying decrease in the coercivity and squareness proceed as the sintering temperature increases and the sintering time increases.

In contrast, abnormal grain growth of the main phase is suppressed by adding Zr, and as a result, it can be interpreted that the coercivity and squareness of the sintered magnet are improved. It is considered that by adding Zr, when the sintering temperature rises or when the sintering time increases, the proceeding of abnormal grain growth is suppressed, so that the coercivity and the squareness can be maintained high. The increase in a ratio of the alloy phase (GBP1) in the grain boundary phase due to the addition of Zr may contribute to improvement of the coercivity.

[3] Addition amount of Zr and magnetic properties

Change in the magnetic properties of the R-T-B-based sintered magnet due to an addition amount of Zr was then examined (Test Method)

Figure 6A:
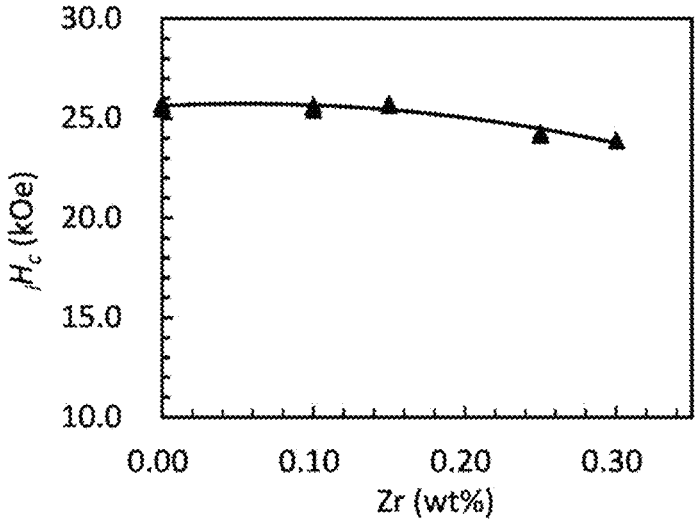
Figure 6B:
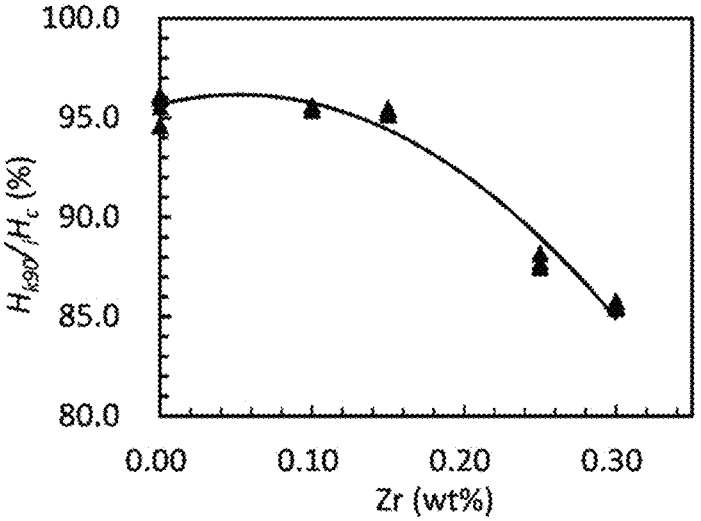

The sintered magnet having the same component composition as that of Example shown in Table 1 was produced. However, as shown in FIGS. 6A and 6B, Zr content was varied in a range of 0% to 0.30%. A method for producing the sample was the same as a test of the "structure of R-T-B-based sintered magnet" described above. The sintering temperature was 975° C. and the sintering time was 4 hours. According to results of FIGS. 5A to 5D obtained by the test of the "structure of R-T-B-based sintered magnet", since the difference in coercivity and squareness due to addition/non-addition of Zr is relatively small when the sintering time is as short as 4 hours, in this test where the sintering time is 4 hours, it can be considered that even in an area where the Zr content is small, abnormal grain growth do not occur or occur slightly.

The coercivity and squareness of the obtained samples were evaluated in the same manner as the "magnetic properties of R-T-B-based sintered magnet".

(Test Result)

FIGS. 6A and 6B show changes in magnetic properties with respect to the Zr content, in which FIG. 6A shows the coercivity, and FIG. 6B shows the squareness. In the figures, an approximate curve is also shown in addition to the measurement results.

According to FIG. 6A, the coercivity only slowly changes with respect to the Zr content. In contrast, in the squareness evaluation result of FIG. 6B, in the region where the Zr content exceeds about 0.15%, the squareness greatly decreases as the Zr content increases. From this, it can be said that it is preferable to keep the Zr content at 0.2% or less, more preferably 0.1% or less in view of maintaining high squareness. It is considered that, due to consumption of B in the main phase by formation of the boride phase and inhibition of aging at the grain boundary (inhibition of diffusion of a rare earth-rich phase during the aging treatment), the squareness decreases as the Zr content increases.

Embodiments of the present invention were described above. The present invention is not particularly limited to these embodiments, and various changes can be performed.

The present application is based on Japanese patent application No. 2018-160472 filed on Aug. 29, 2018, and the contents of which are incorporated herein by reference.

DESCRIPTION OF REFERENCE NUMERALS AND SIGNS

1 Main phase crystal grains
2 Grain boundary
2*a* Two-grain boundary
2*b* Grain boundary triple point
3 Boride phase

What is claimed is:

1. An R-T-B-based sintered magnet, comprising:

a rare earth element R;

a metal element T which is Fe, or comprises Fe and Co with which a part of Fe is substituted;

boron; and a boride forming element M, which includes a metal element other than rare earth elements and the metal element T, and forms a boride, wherein the boride forming element M comprises Zr, wherein the R-T-B-based sintered magnet comprises:

a main phase which comprises a crystal grain of an R-T-B-based alloy; and a boride phase which comprises a compound phase based on the boride of the boride forming element M, and is generated on a preferential growth plane of the crystal grain of the main phase, wherein the boride phase is formed on both of a preferential growth plane facing a two-grain boundary in which two main phase crystal grains are adjacent to each other and a preferential growth plane facing a grain boundary triple point among preferential growth planes of the main phase crystal grains, wherein the sintered magnet is formed by sintering at a sintering temperature in a range of 960° C. to 975° C., and wherein, in the R-T-B-based sintered magnet, a content of 0 is less than 700 ppm by mass, the R-T-B-based sintered magnet including, in terms of mass %:

the rare earth element R in a total content of 27% to 33%;

Co in a content of 0% to 5%;

Al in a content of 0% to 1.0%;

Cu in a content of 0% to 0.5%;

the boride forming element M in a total content of 0.01% to 0.5%; and

B in a content of 0.97% to 1.2%, with a balance being Fe and inevitable impurities.

2. The R-T-B-based sintered magnet according to claim 1, wherein the boride phase is epitaxially grown on the preferential growth plane of the crystal grain of the main phase.

3. The R-T-B-based sintered magnet according to claim 1, wherein the main phase comprises a tetragonal crystal having a preferential growth orientation being an a-axis direction and a b-axis direction, and wherein the preferential growth plane of the crystal grain of the main phase comprises at least one of a plane (110), a plane (100), and a plane (010).

4. The R-T-B-based sintered magnet according to claim 1, wherein the boride forming element M further comprises at least one element selected from the group consisting of Ti, Hf, Nb and Cr.

5. The R-T-B-based sintered magnet according to claim 1, wherein the main phase comprises a tetragonal $Nd_2Fe_{14}B$ phase, and the boride phase comprises the compound phase based on a hexagonal $ZrB_2$ structure, and wherein the boride phase is epitaxially grown on the preferential growth plane of the crystal grain of the main phase in an orientation relationship of $Nd_2Fe_{14}B$ (110)[001]//$ZrB_2$(001)[100].

6. The R-T-B-based sintered magnet according to claim 1, wherein, in the R-T-B-based sintered magnet, each of contents of C and N is less than 1000 ppm by mass.

7. The R-T-B-based sintered magnet according to claim 1, wherein the compound phase has a hexagonal $ZrB_2$ structure.

8. The R-T-B-based sintered magnet according to claim 1, wherein the compound phase has a ZrB phase of a hexagonal AIB2 structure.

9. The R-T-B-based sintered magnet according to claim 1, wherein the compound phase has a structure derived from a $ZrB_2$ phase.

10. The R-T-B-based sintered magnet according to claim 1, wherein the main phase comprises a tetragonal $Nd_2Fe_{14}B$ phase.

11. The R-T-B-based sintered magnet according to claim 1, wherein, in terms of mass %, a content of the Zr in the R-T-B-based sintered magnet is 0.01 mass % or more and less than 0.1 mass %.

12. The R-T-B-based sintered magnet according to claim 1, wherein the metal element T consists of Fe.

13. The R-T-B-based sintered magnet according to claim 1, wherein the boride phase extends on the preferential growth plane facing the two-grain boundary in which two main phase crystal grains of the main phase crystal grain are adjacent to each other.

14. The R-T-B-based sintered magnet according to claim 1, wherein the boride phase includes an epitaxially grown phase on the preferential growth plane.

15. The R-T-B-based sintered magnet according to claim 1, wherein, in terms of mass %, a content of the rare earth element R in the R-T-B-based sintered magnet is in a range from 28% to 32%.

16. The R-T-B-based sintered magnet according to claim 15, wherein, in terms of mass %, a content of Al in the R-T-B-based sintered magnet is in a range from 0.1% to 1.0%.

17. The R-T-B-based sintered magnet according to claim 16, wherein, in terms of mass %, a content of Cu in the R-T-B-based sintered magnet is in a range from 0.1% to 0.5%.

18. The R-T-B-based sintered magnet according to claim 17, wherein, in terms of mass %, a content of the boride forming element M in the R-T-B-based sintered magnet is in a range from 0.05% to 0.2%.

19. The R-T-B-based sintered magnet according to claim 18, wherein, in terms of mass %, a content of Co in the R-T-B-based sintered magnet is in range from 0.8% to 2.5%.

* * * * *